United States Patent [19]

Leupold

[11] Patent Number: 4,862,126

[45] Date of Patent: Aug. 29, 1989

[54] SUPERCONDUCTING SHIELDED PYX PPM STACKS

[75] Inventor: Herbert A. Leupold, Eatontown, N.J.

[73] Assignee: The United States of America as represented by the Secretary of the Army, Washington, D.C.

[21] Appl. No.: 335,649

[22] Filed: Apr. 7, 1989

[51] Int. Cl.[4] ..... H01F 7/22

[52] U.S. Cl. ..... 335/216; 335/306; 315/535; 505/1

[58] Field of Search ..... 335/210, 216, 306; 315/5.26, 5.28, 5.34, 5.35

[56] References Cited

U.S. PATENT DOCUMENTS 3,008,044 11/1961 Buchhold ..... 335/216 X
3,239,725 3/1966 Wiederhold ..... 335/216
3,665,351 5/1972 Donaldson et al. ..... 335/216
4,829,276 5/1989 Leupold et al. ..... 335/306
4,829,277 5/1989 Stamura et al. ..... 335/306

*Primary Examiner*—George Harris
*Attorney, Agent, or Firm*—Michael J. Zelenka; Ann M. Knab

[57] ABSTRACT

Periodic permanent magnet structures comprise a plurality of paired axially aligned segments of transversely sliced or truncated hollow cylindrical flux sources each of which produces a uniform high-field in its central cavity. Each pair of segments is mounted on opposite sides of a respective plate of permeable material. The magnetic field orientations in the central cavities are axially directed and alternate or reverse in direction from segment to segment. An axial bore hole drilled through the segments and plates provides a continuous channel or path through which a beam of charged particles will travel.

10 Claims, 2 Drawing Sheets

SUPERCONDUCTING SHIELDED PYX PPM STACKS

The invention described herein may be manufactured, used, and licensed by or for the Government for governmental purposes without the payment to me of any royalties thereon.

TECHNICAL FIELD

The present invention relates to periodic permanent magnet structures (PPMs) for use in microwave/millimeter wave devices such as traveling wave tubes (TWTs).

BACKGROUND OF THE INVENTION

Both electromagnets and permanent magnets have been used to manipulate beams of charged particles. In traveling wave tubes for example, magnets have been arranged around the channel through which the beam travels to focus the stream of electrons; that is, to reduce the tendency of the electrons to repel each other and spread out. Various configurations of permanent magnets have been attempted in an effort to increase the focusing effect while minimizing the weight and volume of the resulting device. In conventional traveling wave tubes, permanent magnets are typically arranged in a sequence of alternating magnetization, either parallel to, or anti-parallel to, the direction of the electron flow. The magnets are usually annular in shape and their axes are aligned with the path of the electron beam.

Reference is made herein to the hollow cylindrical flux source (HCFS) principle described by K. Halbach in "Proceedings of the Eighth International Workshop on Rare Earth Cobolt Magnets", Univ. of Dayton, Dayton, Ohio, 1985 (pp. 123–136). A HCFS is essentially a permanent magnet shell that produces an internal magnetic field which is relatively constant in magnitude. The field, which is perpendicular to the axis of the cylinder, possesses a strength which can be greater than the remanence of the magnetic material from which the HCFS is made.

Ideally, the HCFS is an infinitely long annular cylindrical shell with a circular cross section, that produces an intense transverse magnetic field in its interior working space. No magnetic flux extends to the exterior of the ring structure (except at the ends of a finite cylinder).

Recently, this principle has been applied to PPM structures. In devising these magnetic structures there has been continuing concern on how to maximize the strength of the magnetic field without increasing the mass of the magnetic structure. The present invention addresses this problem, and others.

SUMMARY OF THE INVENTION

The present invention offers focusing fields equal to that of a HCFS stack and because it reduces the (magnetic field) period, substantially higher frequency TWT (traveling wave tube) radiation sources can be constructed. Also the invention results in lower internal operating temperatures in the PPM stack and therefore higher magnetic fields, better beam focusing, more efficient tube operation and longer tube life can be realized.

The present invention makes advantageous use of segments of transversely sliced or truncated hollow cylindrical flux sources disclosed in the co-pending application of the present inventor, Ser. No. 327,931 filed Mar. 23, 1989, which is incorporated by reference herein. Each flux source produces a uniform high-field in its central cavity. For TWT purposes, each flux source has an axial tunnel drilled through its magnetic poles to permit passage of a beam of charged particles.

Briefly and in accordance with the present invention, each of the segments of transversely sliced hollow cylindrical flux sources are divided by a plate of permeable material and the polarities in the central cavities of successive segments are reversed from segment to segment. The permeable material is of high saturation and it creates an "anti-mirror" image of the segment in its plane magnetically completing the other half of the central cavity. This results in an axial (magnetic) field period that is half that of the transversely sliced hollow cylindrical flux source stack having no permeable plates. The resultant PPM stack comprises a series of paired axially aligned flux source segments in peripheral edge contact wherein the magnetic field orientations in the central cavities alternate or reverse in direction from segment to segment. An axial bore hole through the magnetic poles of the flux sources and permeable plates provides a continuous channel or path through which a beam of charged particles will travel.

The segments of transversely sliced hollow cylindrical flux sources may be in quarters or halves. When quarter segments are used, a superconducting planar sheet bounds the bottoms of the quarters providing a magnetic "mirror image" of the quarter segments.

BRIEF DESCRIPTION OF THE DRAWINGS

The objects, features, and details of the invention will become more readily apparent in light of the detailed description and disclosure in connection with the accompanying drawings wherein.

DETAILED DESCRIPTION

Figure 1:
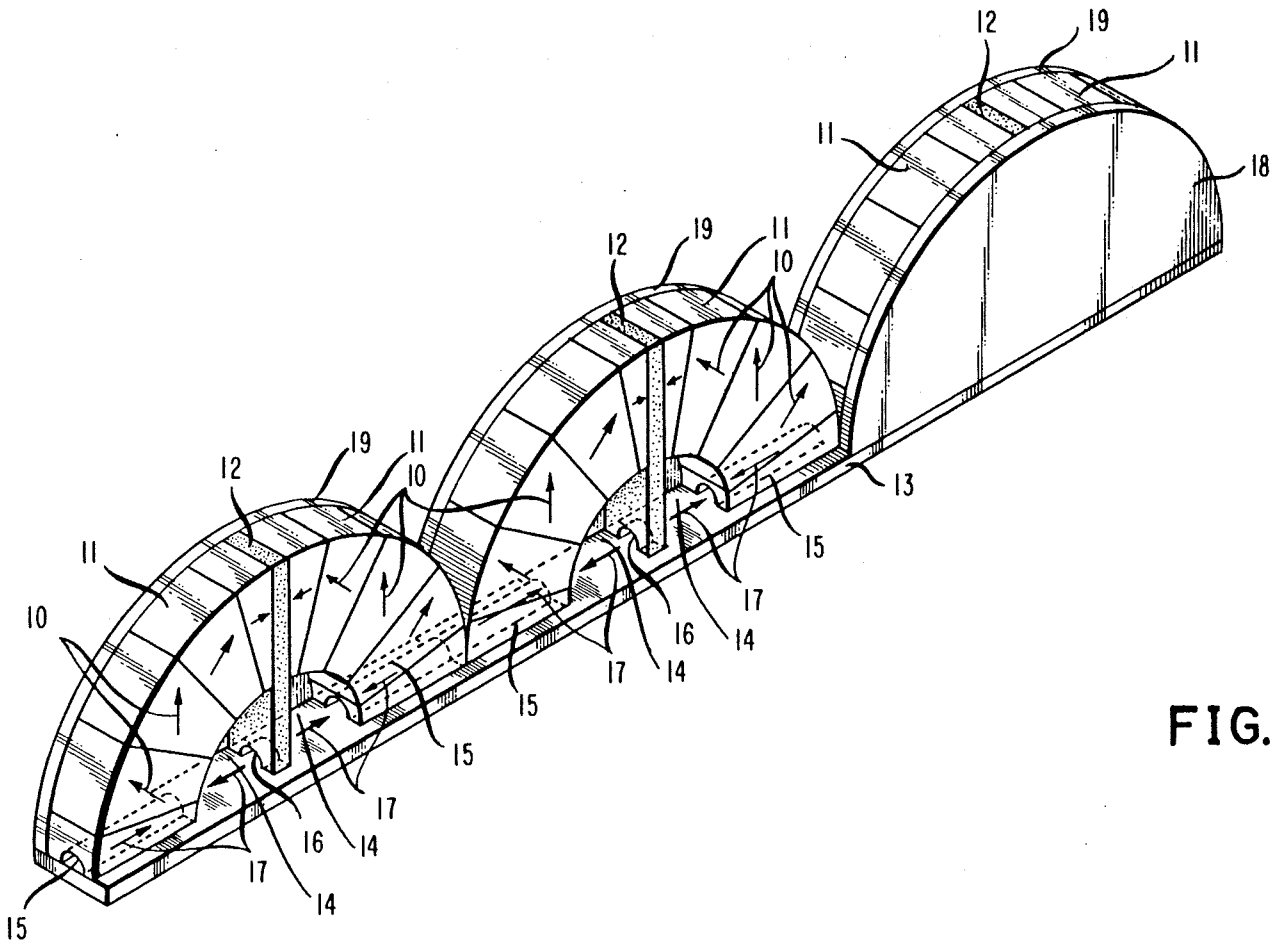
FIG. 1 illustrates an abbreviated series of quarter segments of sliced hollow cylindrical flux sources forming a PPM structure in accordance with the present invention.

FIG. 1 shows a series of paired quarter segments of transversely sliced hollow cylindrical flux sources 11 arranged linearly with adjacent paired segments 11 in peripheral edge contact and their internal magnetic fields in alignment. The pairs of quarter segments are placed on opposite sides of a planar sheet 12, which is composed of high saturation, high permeability material. A superconducting planar sheet 13 bounds the bottom edges or surfaces of the segments. Each quarter segment has a central cavity 14 and an axial bore hole is drilled through the magnetic pole of each quarter magnetic segment and through each permeable planar sheet 12 to create respectively, an axial tunnel 15 and borehole 16.

The cavity radius is approximately the same width as the wall or shell thickness of each flux source. The large arrows 17 designate the direction of the magnetic fields in the central cavities and axial tunnels. The flux sources are arranged linearly, axially aligned, with adjacent flux sources in peripheral edge contact so that the magnetic fields are in alignment, forming a continuous channel or path through which a beam of charged particles may travel.

The permeable planar sheets 12 create a magnetic "anti-mirror" image of each quarter segment making the quarter central cavity appear (magnetically) as if a semicylindrical segment were its source. With the aid of the superconducting planar sheet 13 a "mirror" image of the semicylindrical segment is magnetically created. Therefore, the magnetic field supplied by a full cylindrical flux source structure may be obtained, but with one quarter the magnetic structure, through the utilization of a high permeable planar sheet and a superconducting planar sheet.

These permeable planar sheets 12 may be comprised of iron, permandur, permalloy, etc. As is known to those skilled in the art, the plate must be thick enough to prevent saturation of the plate material. Stated somewhat differently, the flux in the cavity must not exceed an amount that will result in a value of B (flux density) in the anti-mirror material that is greater than its saturation value. Thus, there is an interrelationship between the desired cavity field and the plate thickness.

Superconducting sheets 18 and 19 cover the faces of the flux sources and are figuratively shown as being peripherally coextensive with the flux sources. These sheets can extend beyond the flux sources, in one or more directions, although it is only necessary they be not less in extent than the sources 11. As evident from the figure, the first two pairs of flux sources are left uncovered by superconducting sheets (18) in order that a clear picture of the present invention be provided. In actual electronic devices a series of perhaps ten or more pairs is typically used, but for purposes of illustration a series of three is sufficient.

As noted previously, the ideal HCFS is an annular cylindrical shell that produces a uniform high-field in its central cavity. Unfortunately, the ideal HCFS is not feasible to construct. Therefore, a segmented approximation is resorted to wherein each segment represents a different magnetic orientation. The small arrows 10 indicate the magnetization orientation at various points. Fortunately, even as few as eight segments provides a field strength that is 90 percent of that of the ideal structure. The resulting magnetic field H, may be calculated from the following equation:

$$H = B_r \ln (R_o/R_i)$$

wherein $B_r$ = remanence of HCFS material $R_o$ = outer radius of HCFS $R_i$ = inner radius of HCFS.

Theoretically, a HCFS must be infinitely long to provide uniform field strength. However, the various applications of the HCFS in the electronics field demand that the length of the HCFS be limited. The present invention provides feasible truncated HCFSs.

The superconducting sheets 18 and 19 that are placed on the end faces of the flux sources act as diamagnetic mirrors to the field abutting the sheet surface. Thus, the image of the cavity fields in the superconducting sheets appears to continue longitudinally in both directions. Infinitely long HCFSs having uniform field strengths are thus magnetically created through the utilization of the superconducting sheets. Also, with the addition of the superconducting sheets there is no magnetic flux leakage since a magnetic field cannot penetrate a superconducting sheet. The superconducting sheets create an image as if there were a series of infinitely long hollow cylindrical flux sources side by side.

The superconducting face sheets 18, 19 and planar sheet 13 shown in the figure are typically quite thin. In practice, the essential requirement is that the sheets be thicker than the penetration depth of the specific superconducting material used. Materials such as tin, lead, niobium, tantalum among others are known to be superconducting below a distinct critical temperature. New ceramic-type materials have been recently developed in the field of superconductivity and are capable of achieving the superconducting state at critical temperatures above 77° K, the boiling point of liquid nitrogen. One such compound $RBa_2Cu_3O_{9-y}$ (where R stands for a transition metal or rare earth ion and y is a number less than 9, preferable $2.1 \pm 0.05$) has demonstrated superconductive properties above 90° K. Forming techniques include plasma spraying, sputtering, epitaxial film growing, etc. These materials and forming processes are merely exemplary and in no way limit the superconductivity material selected for the sheets, and the manner thereof in which the material is formed.

As apparent from the figure, the magnetic field orientation in the central cavities of alternate quarter segments is reversed. The magnetic field orientation in each axial tunnel 15 is the opposite of that in the adjacent cavity and therefore a continually alternating magnetization along the particle beam path is fully realized. Consequently, the (magnetic field) period to bore ratio is reduced to half the period to bore ratio of a HCFS stack absent the permeable plates 12. This provides a field period to bore hole ratio of substantially 4 to 1.

The permeable plates 12 are much better heat conductors than the magnetic segments and these plates can extend beyond the periphery of the adjoining segments. As a result, higher magnetic fields can be achieved, as well as better beam focusing, more efficient tube operation and longer tube life.

Figure 2:
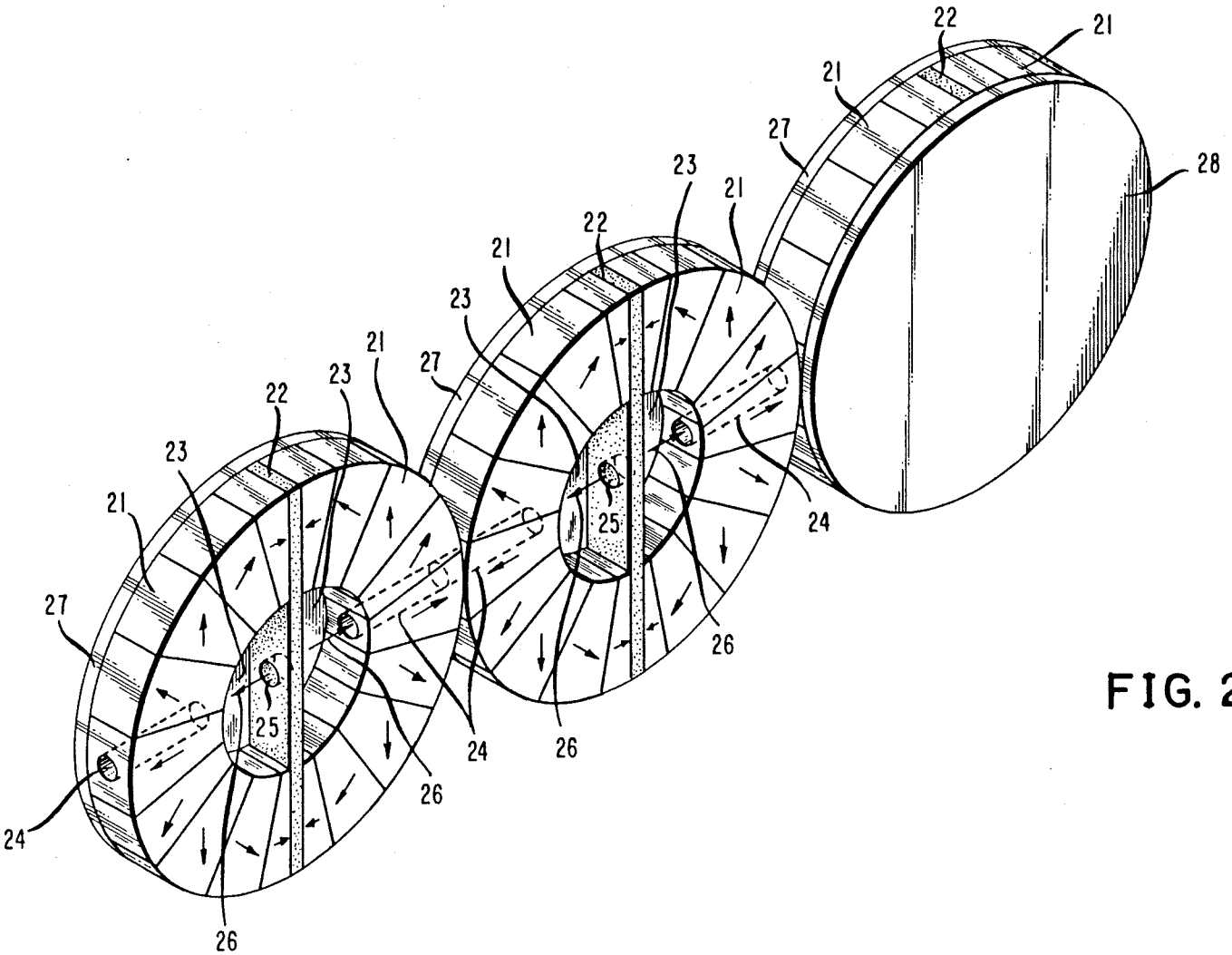
FIG. 2 illustrates an abbreviated series of semicylindrical segments of sliced hollow cylindrical flux sources forming a PPM structure in accordance with the present invention.

FIG. 2 depicts an alternate embodiment of the present invention. A series of paired semicylindrical segments of sliced hollow cylindrical flux sources 21 are arranged linearly with adjacent paired segments 21 in peripheral edge contact and their internal magnetic fields in alignment. Each pair of semicylindrical segments are placed on opposite sides of a planar sheet 22 composed of high saturation, high permeability material. Each semicylindrical segment has a central cavity 23 and an axial bore hole is drilled through the magnetic pole of each semicylindrical segment and through each planar sheet to create, respectively, an axial tunnel 24 and bore hole 25. The large arrows 26 designate the direction of the magnetic field in the central cavities. The flux sources are arranged linearly with paired adjacent flux sources in peripheral edge contact so that the magnetic fields are in alignment to form a continuous channel or path through which a beam of charged particles may travel. As with the quarter segments, an "anti-mirror" image is created here making the central cavity appear (magnetically) as if a full cylindrical segment were its flux source. Superconducting sheets 27 and 28 cover the faces of the flux sources.

The magnetic field orientation in the central cavities of alternate semicylindrical segments is reversed and the magnetic field orientation in each axial tunnel is the opposite of that in the adjacent cavity. A continually alternating magnetization along the particle beam path with a shorter period is thus achieved.

The magnetic material of the quarter and semicylindrical segments may be composed of $Nd_2Fe_{14}B$, $SmCo_5$, $PtCo_5$, $Sm_2(CoT)_{17}$ where T is one of the transition metals, and so on. The foregoing materials are characterized by the fact that they maintain their full magnetization to fields larger than their coereivities. These and other equivalent magnetic materials (e.g., selected ferrites) are known to those in the art. Accordingly, it is to be understood that the principles of the present invention are in no way limited to the magnetic material selected for the segments. Also, as known to those skilled in the art, the segments can be pressed to the appropriate shape(s) and magnetized in the desired orientation using any of the known magnetization techniques.

Having shown and described what is at present considered to be the preferred embodiments of the invention, it should be understood that the same has been shown by way of illustration and not limitation. And, all modifications, alternations and changes coming within the spirit and scope of the invention are meant to be included herein.

What is claimed is:

1. A periodic permanent magnet structure comprising a plurality of paired segments of sliced hollow cylindrical flux sources, each flux source producing a uniform high-field in its central cavity, each pair of segments being mounted on opposite sides of a respective plate of permeable material so that the plate closes the open ends thereof, each flux source having an axial bore hole through the magnetic pole of the flux source, said bore hole continuing through each plate of permeable material, each set of paired segments being in peripheral edge contact so that the magnetic field orientations are in alignment so as to form a continuous channel through the plurality of axially aligned flux sources, and a pair of superconducting sheets covering the end faces of each sliced flux source.

2. A periodic permanent magnet structure as defined in claim 1 wherein the magnetic fields in each pair of segments are in opposite directions.

3. A periodic permanent magnet structure as defined in claim 2 comprising paired quarter segments of sliced hollow cylindrical flux sources, each quarter segment having a flat bottom half, and further comprising a superconducting planar sheet bounding the flat bottom halves of the flux sources.

4. A periodic permanent magnet structure as defined in claim 3 wherein the structure has a field period to bore hole ratio of substantially four to one.

5. A periodic permanent magnet structure as defined in claim 4 wherein the magnetic field orientation in each axial bore hole of each segment is the reverse of that in the adjacent cavity.

6. A periodic permanent magnet structure as defined in claim 5 wherein the plates of permeable material are at least peripherally coextensive with the segments mounted thereon.

7. A periodic permanent magnet structure as defined in claim 2 comprising paired semicylindrical segments of sliced hollow cylindrical flux sources.

8. A periodic permanent magnet structure as defined in claim 7 wherein the structure has a field period to bore hole ratio of substantially four to one.

9. A periodic permanent magnet structure as defined in claim 8 wherein the magnetic field orientation in each axial bore hole of each segment is the reverse of that in the adjacent cavity.

10. A periodic permanent magnet structure as defined in claim 9 wherein the plates of permeable material are at least peripherally coextensive with the segments mounted thereon.

* * * * *